US008494426B2

(12) United States Patent
Maeda

(10) Patent No.: US 8,494,426 B2
(45) Date of Patent: Jul. 23, 2013

(54) LASER FIXING DEVICE AND IMAGE FORMING APPARATUS INCLUDING THE SAME

(75) Inventor: Tomohiro Maeda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 285 days.

(21) Appl. No.: 13/092,457

(22) Filed: Apr. 22, 2011

(65) Prior Publication Data

US 2011/0262196 A1 Oct. 27, 2011

(30) Foreign Application Priority Data

Apr. 26, 2010 (JP) ..... 2010-101227

(51) Int. Cl.
*G03G 15/20* (2006.01)

(52) U.S. Cl.
USPC ..... 399/336

(58) Field of Classification Search
USPC ..... 399/122, 320, 335–338
See application file for complete search history.

(56) References Cited

U.S. PATENT DOCUMENTS 5,337,182 A 8/1994 Tomita

FOREIGN PATENT DOCUMENTS

| | | | |
|---|---|---|---|
| JP | 59-126574 | * | 7/1984 |
| JP | 3-73910 | A | 3/1991 |
| JP | 07-191560 | A | 7/1995 |
| JP | 2000-194215 | A | 7/2000 |
| JP | 2002-139923 | A | 5/2002 |
| JP | 2006-074245 | A | 3/2006 |
| JP | 2006-088199 | A | 4/2006 |

* cited by examiner

*Primary Examiner* — Hoan Tran
(74) *Attorney, Agent, or Firm* — Renner, Otto, Boisselle & Sklar, LLP

(57) ABSTRACT

In a fixing device, the surface of the recording paper carrying belt passes through a position satisfying a relation:

$f<L\leqq f+a$, where L is a distance (mm) from the center of a condensing lens 112 to the position along the optical axial direction, the condensing lens 112 being the last condensing lens that laser light irradiated from a laser light source passes through, f is a focal distance (mm) of the condensing lens 112, and a is a range (mm) along the optical axial direction from the focal position of the condensing lens 112 to a position, within which range fixability of toner is within a set permissible range.

6 Claims, 4 Drawing Sheets

LASER FIXING DEVICE AND IMAGE FORMING APPARATUS INCLUDING THE SAME

This Nonprovisional application claims priority under 35 U.S.C. §119(a) on Patent Application No. 2010-101227 filed in Japan on Apr. 26, 2010, the entire contents of which are hereby incorporated by reference.

TECHNICAL FIELD

This invention relates to a fixing device for fixing, by means of laser light, an unfixed image formed on a recording material, and an image forming apparatus including the fixing device.

BACKGROUND ART

An image forming apparatus of an electrophotographic printing type such as a printer includes a fixing device for thermally melting a toner image formed on a recording material (sheet of recording paper, recording sheet) so as to fix the toner image to the recording material. As an example of fixing methods carried out in this fixing device, there is known a method of fixing a toner image on a recording material in a non-contact manner by irradiating the toner image with light. Since the toner image is heated in a non-contact manner, no warming up is needed in this method unlike in a roller fixing method that is a conventional contact heating method.

As a fixing device making use of light irradiation as described above, a laser fixing device as disclosed in Patent Literature 1 has been proposed in which a toner image is fixed by utilizing laser power. Patent Literature 1 discloses provision of an optical unit which has first and second laser light scanning irradiation means and forms a latent image by means of the first laser light scanning irradiation means, and of means for fixing a toner image, which is developed on a recording material, by means of the second laser light scanning irradiation means using light energy as a heat source. The laser light irradiated from the second laser light scanning irradiation means is converted into parallel light by means of a collimating lens constituted by spherical and/or aspherical surfaces, and then focused to a position through which a predetermined recording material passes, by means of f-θ lenses via a reflecting mirror for fixation. The fixation is carried out at this focal position. In this way, the position at which the fixation is carried out in the process of carrying the recording material is determined by adjusting to the focal distance.

CITATION LIST

Patent Literature 1

Japanese Patent Application Publication, Tokukai, No. 2000-194215 A (Publication Date: Jul. 14, 2000)

SUMMARY OF INVENTION

Technical Problem

In the fixing device disclosed in Patent Literature 1, the recording material passes through a focal distance position of the laser light. It is difficult, however, to have the recording material pass through the focal position if conditions of the recording material being carried change, for example, in a case where the thickness of the recording material changes depending on the type of the recording material or the recording material being carried is lifted up from a carrying member. This may result in a poor fixation.

The present invention is accomplished in view of the aforementioned problems. An object of the present invention is to achieve a laser fixing device which can exhibit satisfactory fixability even in a case where the recording material misses the focal position, for example, in a case where the thickness of the recording material changes depending on the type of the recording material or in a case where a so-called lift occurs in which the recording material being carried is lifted from the carrying member, and also to achieve an image forming apparatus including the laser fixing device.

Solution to Problem

In order to attain the object, a laser fixing device according to the present invention is a laser fixing device including: a carrying section having a carrying member for carrying a recording material placed on a surface of the carrying member; a laser irradiation section; and at least one condensing lens, one of which is a final condensing lens being the last condensing lens that the laser light passes through among the at least one condensing lens; the laser fixing device fixing unfixed toner on the recording material to the recording material by melting the unfixed toner with laser light having been irradiated from the laser irradiation section and passed through the condensing lens, the recording material being carried by the carrying section in a direction perpendicular to an optical axial direction of the laser light, wherein the surface of the carrying member passes through a position satisfying a relation: $f<L\leqq f+a$, where L is a distance (mm) from the center of the final condensing lens to the position along the optical axial direction, f is a focal distance (mm) of the final condensing lens and a is a range (mm) along the optical axial direction from the focal position of the final condensing lens to a position, within which range fixability of toner is within a set permissible range.

Advantageous Effects of Invention

In a fixing method using a laser, the energy ($J/mm^2$) received by unfixed toner being carried per unit area is determined by multiplying the light output per unit area ($W/mm^2$) that is applied within the light irradiation area (spot diameter), by the time (s). Therefore, in a case where the same quantity of energy [(light output per unit area)×(light irradiation time)] is applied for fixation, it is preferable to condense light by means of a lens to thereby increase the light output (watt density) per unit area, and shorten the light irradiation time [(high watt density)×(short-time irradiation)]. In this way, it becomes possible to efficiently heat only the toner, while minimizing heat dissipation to the sheet of recording material and the atmosphere. Consequently, since the maximum watt density is observed at a focal distance f (focal position) from the final condensing lens, it follows that fixation can be most efficiently carried out at the focal position. It is understood, however, that the toner can be fixed even at a position shifting from the focal position, since the toner is still given energy.

In the above-described configuration according to the present invention, a is a range (mm) along the optical axial direction from the focal position of the final condensing lens to a position, within which range fixability of toner is within a set permissible range. Consequently, fixability (fixation strength) within the permissible range is obtained at a position L that satisfies a relation: $f-a\leqq L\leqq f+a$. Therefore, by setting the permissible range as a range within which substantially the same level of fixability as that at the focal position is obtained, for example, a range within which fixability at a level that is different from that of the fixability at the focal position by only a few percent, it becomes possible to obtain substantially the same level of fixability as that at the focal position, at a position L that satisfies the relation: $f-a \leqq L \leqq f+a$.

In this configuration, the surface of the recording material passes through a position away from the center of the final condensing lens by a distance L (mm) in the optical axial direction, L satisfying the relation: $f<L \leqq f+a$. Because of this, the surface of the carrying member passes through the position L ($f<L \leqq f+a$), even if the thickness of the recording material changes depending on the type of the recording material to be carried or a so-called lift occurs in which the recording material is lifted from the surface of the carrying member while being carried. Consequently, the recording material placed on the surface of the carrying member and the toner image on the recording material pass through a position (the focal position or a position giving substantially the same level of fixability as that at the focal position) that gives fixability within the permissible range, although the recording material on the surface of the carrying member and the toner image on the recording material come slightly closer to the final condensing lens than the surface of the carrying member. Therefore, it is possible to efficiently and reliably fix the unfixed toner image on the recording material, even in a case where the recording material misses the focal position, for example, in a case where the thickness of the recording material changes depending on the type of the recording material or the recording material is lifted while being carried.

The sheet of recording material that can be used in the image forming apparatus has a much smaller thickness than the length a. Due to this, even if the surface of the carrying member is set to pass through a position near f, there is little possibility that the recording material on the carrying member will come closer to the final condensing lens than the position f–a. Therefore, fixability within the permissible range can always be obtained.

Further, in production of the laser fixing device, it will suffice to set the surface of the recording material to pass through the position satisfying the relation: $f<L \leqq f+a$, and there is no need of accurately matching the surface position with the focal distance as in conventional cases.

DESCRIPTION OF EMBODIMENTS

A preferred embodiment of the present invention will be described below in detail with reference to the attached drawings. In the Description and Drawings of the present invention, elements having substantially the same function will be given the same reference number so as to avoid a redundant explanation on such elements.

Image Forming Apparatus

Figure 2:
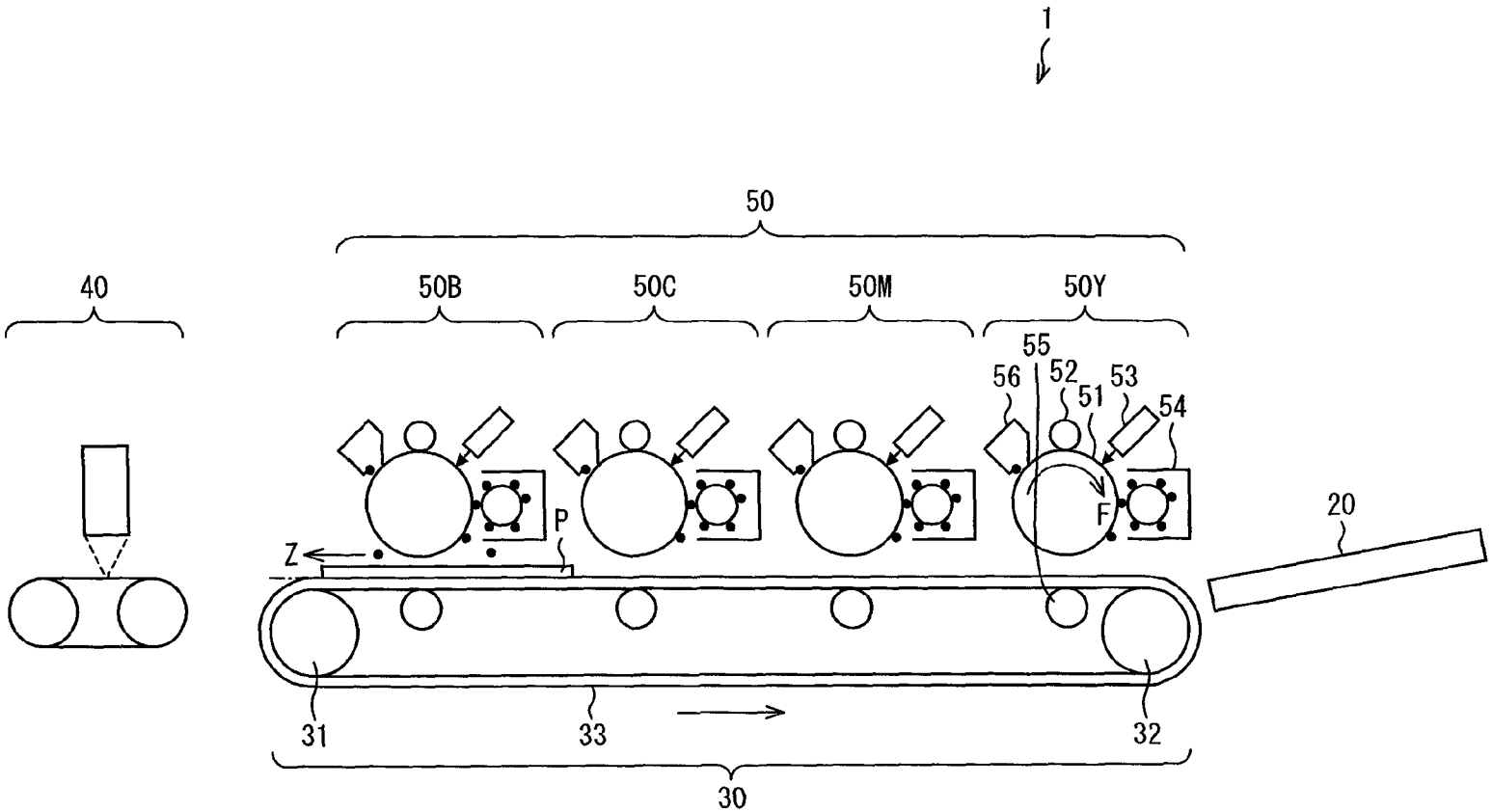
FIG. 2 is a schematic block diagram of an image forming apparatus according to one embodiment of the present invention.

An image forming apparatus according to one embodiment of the present invention will be described below with reference to FIG. 2. FIG. 2 is a schematic view of the internal structure of an image forming apparatus 1 according to this embodiment. The image forming apparatus 1 is a color image forming apparatus employing a dry electrophotographic printing method and forms a multicolor or monochrome image on a predetermined sheet of recording paper (recording material, recording sheet) P based on image data or the like transmitted, for example, from terminal devices on a network.

As illustrated in FIG. 2, the image forming apparatus 1 includes a visible image forming unit 50, a feeding tray 20, recording paper carrying means 30, and a fixing device (laser fixing device) 40. It should be noted that, although the present embodiment employs a configuration in which an image (toner image) developed at the visible image forming unit 50 is directly transferred to the sheet of recording paper P, the present invention may alternatively employ a configuration in which the image is transferred to an intermediate transfer medium such as an intermediate transfer belt.

In the visible image forming unit 50, four visible image forming units 50Y, 50M, 50C, and 50B are juxtaposed to each other, respectively corresponding to the colors yellow (Y), magenta (M), cyan(C), and black (B). In other words, the visible image forming unit 50 is made up from the four visible image forming units 50Y, 50M, 50C, and 50B. The visible image forming unit 50Y forms an image using yellow (Y) toner. The visible image forming unit 50M forms an image using magenta (M) toner. The visible image forming unit 50C forms an image using cyan (C) toner. The visible image forming unit 50B forms an image using black (B) toner. Here, the arrangement of a so-called tandem type is employed, in which a set of the four visible image forming units 50Y, 50M, 50C, and 50B are arranged along a carrying path for carrying the sheet of recording paper P from the feeding tray 20 to the fixing device 40.

The visible image forming units 50Y, 50M, 50C, and 50B have substantially the same configuration. That is, each of the visible image forming units 50Y, 50M, 50C, and 50B includes a photoreceptor 51, a charger 52, laser light irradiation means 53, a developer 54, a transfer roller 55, and a cleaner unit 56, and the toner of each color is multi-transferred to the sheet of recording paper P being carried.

The photoreceptor 51 supports an image formed on the surface thereof. The charger 52 charges the surface of the photoreceptor 51 uniformly at a predetermined potential.

The laser light irradiation means 53 exposes the surface of the photoreceptor 51 charged by the charger 52, according to image data inputted to the image forming apparatus 1, thereby forming an electrostatic latent image on the surface of the photoreceptor 51. The developer 54 develops the electrostatic latent image formed on the surface of the photoreceptor 51 using the toner of each color. The transfer roller 55 is applied thereto a bias voltage having a reverse polarity to the polarity of the toner, and transfers the toner image to the sheet of recording paper P carried by the recording paper carrying means 30. The recording paper carrying means 30 will be described later.

The cleaner unit 56 removes and collects toner remaining on the surface of the photoreceptor 51 after the development process at the developer 54 and the transfer of the image formed on the photoreceptor 51.

The transfer of a toner image to the sheet of recording paper P as described above is sequentially carried out at each of the visible image forming units. That is, the transfer is repeatedly carried out four times for the four colors, whereby toner images of the respective colors are multi-transferred on the sheet of recording paper P.

The recording paper carrying means 30 includes a driving roller 31, an idling roller 32, and a carrying belt 33, and carries the sheet of recording paper P so that the toner image is formed on the sheet of recording paper P at the visible image forming unit 50. An endless carrying belt 33 runs around the driving roller 31 and the idling roller 32. The driving roller 31 is controlled to rotate at a predetermined circumferential velocity, thereby causing the endless carrying belt 33 to rotate. The carrying belt 33 retains static electricity on the outer surface thereof, and carries the sheet of recording paper P while electrostatically adsorbing the same.

The sheet of recording paper P having been carried by the recording paper carrying means 30 through the visible image forming units and received the unfixed toner image transferred thereon is peeled off from the carrying belt 33 due to curvature of the driving roller 31 and carried to the fixing device 40.

The fixing device 40 applies a proper amount of heat to the sheet of recording paper P by means of laser light so as to melt the toner transferred on the sheet of recording paper P, thereby fixing the toner to the sheet of recording paper P. The fixing device 40 then discharges the sheet of recording paper P to a paper output tray (not shown).

The operation of each of the above-mentioned members included in the image forming apparatus 1 is controlled by a main control section (integrated circuit for control, or computer, not shown).

Fixing Device

Next, the fixing device 40 will be described in detail referring to FIG. 1, which is a view of the fixing device 40 according to the present embodiment seen from the paper carrying direction.

The fixing device 40 includes a laser light source (laser irradiation section) 105 and a recording paper carrying device (carrying section) 107 which carries the sheet of recording paper P. The fixing device 40 also includes a collimating lens 111 and a condensing lens (final condensing lens) 112 which condenses laser light irradiated from the laser light source 105.

The sheet of recording paper P is carried by the recording paper carrying device 107 in a direction perpendicular to the optical axial direction of the laser light irradiated from the laser light source 105. The unfixed toner image on the sheet of recording paper P is melted so as to be fixed to the sheet of recoding paper P, by means of the laser light having been irradiated from the laser light source 105 and passed through the collimating lens 111 and the condensing lens 112.

It should be noted that, although the present embodiment uses a semiconductor laser as the laser light source 105, the laser light source 105 according to the present invention is not limited to a semiconductor laser and may alternatively be other laser. Semiconductor lasers are less expensive and more compact than other lasers such as a carbon dioxide gas laser. Also, semiconductor lasers can generate a laser with a desired wavelength in a wavelength region ranging from 400 nm to 1000 nm, depending on the combination of the semiconductor devices and the composition of the material. Example to be described later uses a semiconductor laser with a wavelength of 808 nm.

Further, the laser light source 105 used in the present embodiment is of a semiconductor laser array in which a plurality of semiconductor laser devices are arranged in a row in a longitudinal direction (scanning direction). In the Example to be described later, a semiconductor laser array is employed in which twenty laser devices each having a maximum output of 1.5 W are arranged at arrangement intervals p of 0.5 mm. It should be noted that this is merely an exemplary arrangement and the present invention may employ other arrangement. The laser light source 105 is connected with a control circuit (not shown) and can be controlled to output light with a desired output within a range equal to or lower than the maximum output.

The laser light irradiated from the laser light source 105 is converted into parallel light by means of the collimating lens 111 and condensed by means of the condensing lens 112 so as to be focused at a focal position B. Here, light perpendicular to the direction in which the sheet of recording paper is carried is not particularly condensed. In FIG. 1, the broken line indicates the optical axis of laser light emitted from the laser light source 105 and the dash-dotted lines indicate the light pass. The distance between the focal position B and the center of the condensing lens 112 along the optical axial direction is referred to as a focal distance f.

The recording paper carrying device 107 includes two tension rollers 101 and 102 and a recording paper carrying belt (carrying member) 103 which is heat resistant and has no end. The sheet of recording paper P is carried on the surface of the recording paper carrying belt 103.

Two tension rollers 101 and 102 have their axial cores connected with bearings (not shown). The tension roller 101 is connected with a driving section (not shown) via a gear (not shown) and driven to rotate. The tension roller 102 rotates along with the rotation of the tension roller 101.

The recording paper carrying belt 103 is an endless belt and carries the sheet of recording paper P by placing the same on the surface of the recording paper carrying belt 103. The recording paper carrying belt 103 is made from a material formed by dispersing an electrically conductive material such as carbon in resin such as polycarbonate resin, vinylidene fluoride resin, polyamide-imide resin, and polyimide (PI) resin.

The recording paper carrying device 107 includes bias application means (bias application section) 110 which is connected with the inner surface of the recording paper carrying belt 103. The recording paper carrying belt 103 receives a voltage applied thereto by the bias application means 110 so as to electrostatically adsorb the sheet of recording paper P onto the surface (outer circumferential surface) of the recording paper carrying belt 103. Due to the electrostatic adsorption of the sheet of recording paper P onto the recording paper carrying belt 103, the recording paper carrying belt 103 and the sheet of recording paper P are brought into close contact with each other. Consequently, it becomes possible to minimize the occurrence of a so-called bend, a state in which the sheet of recording paper P being carried bends to thereby depart from the recording paper carrying belt 103.

The recording paper carrying device 107 includes a tension roller 113 (abutting member) which gives a tension to the recording paper carrying belt 103. The tension roller 113 is in contact with the recording paper carrying belt 103 behind the surface of the recording paper carrying belt 103 at an irradiation position being a position at which the recording paper carrying belt 103 is irradiated with the laser light. In the present embodiment, the tension roller 113 is arranged at a position where the central axis of the tension roller 113 orthogonally intersects the optical axis of the laser light at the laser light irradiation position. Thus, in the laser light irradiation area, the tension roller 113 can prevent the surface of the recording paper carrying belt 103 from getting shaky due to vibrations at the time of carrying. Consequently, the surface of the recording paper carrying belt 103 can be kept at an accurate position.

Figure 1:
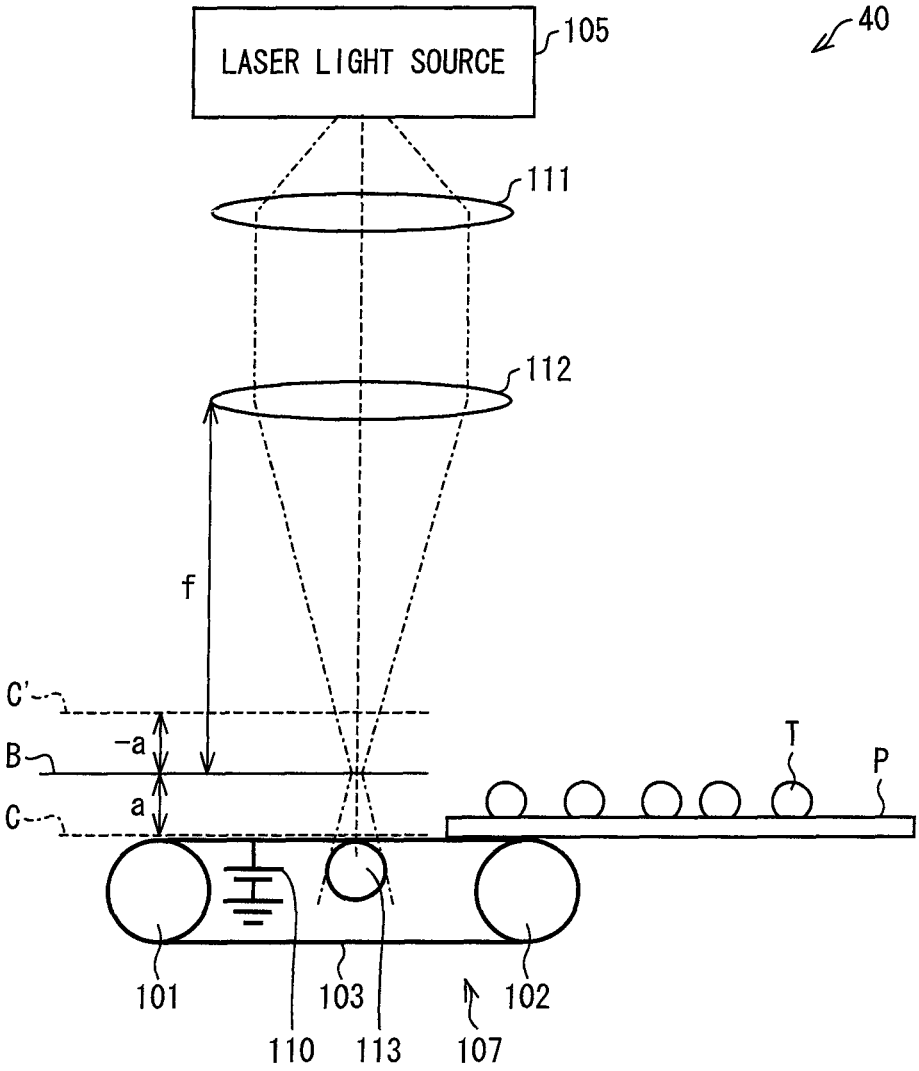
FIG. 1 is a schematic cross-sectional view of a fixing device according to one embodiment of the present invention.

In the present embodiment, the surface of the recording paper carrying belt 103 is set such that the surface of the recording paper carrying belt 103 intersects the optical axis of the laser light in a plane perpendicular to the optical axis of the laser light and the surface of the recording paper carrying belt 103 is located at a position C away from the focal position B by a (mm) in the optical axial direction, as illustrated in FIG. 1. In this way, the present embodiment employs a configuration in which the surface of the recording paper carrying belt 103 is positioned within a range from the focal position to the position C (exclusive of the focal position). The detail of this range will be described in the experimental result in the Example to be described later. Here, distances (shift lengths from the focal position) a from a focal position B to positions C and C' that are away from the focal position B in the optical axial direction will be described below.

First, an explanation will be given on the fact that the distance (shift length) a from the focal position B is different in concept from focal depth in general optical systems. Focal depth in general optical systems denotes a range within which a clear, unblurred image can be obtained even if an object is shifted forward and backward from the focal position of the lens. Here, the focal depth is determined according to the NA (numerical aperture) of the condensing lens and the wavelength, as shown by the following formula:

Focal depth=wavelength/($2\times NA^2$).

For example, when the wavelength of laser light is 808 nm and the NA of a condensing lens is 0.08, the focal depth will be 63 μm. On the other hand, in a case where an unfixed toner image is fixed by laser light irradiation, the energy received by the toner is determined by the formula: [quantity of light received by the toner in the light irradiation area (spot diameter)]×[irradiation time]. Consequently, in experiments in the following Example, it was possible to maintain fixability even when the distance (shift length) a from the focal position B was longer than the focal depth. This will be described in detail later. Therefore, the distance a from the focal position with which fixability can be secured in the present invention is different in concept from focal points in general.

Example

In the following example, a description will be given on the result of measurement of differences in fixability in a case where a toner image was fixed with laser while maintaining the output of the laser light at the constant level and changing the recording paper carrying position along the optical axial direction. In this example, a fixing device having the configuration as described in the above-described embodiment with reference to FIG. 1 was used.

First, an unfixed toner image, formed by printing a black solid image with an attachment quantity (weight of unfixed toner attached per unit area) of 0.4 mg/cm$^2$ on a sheet of recording paper P, was carried by the recording paper carrying belt 103 at a process speed of 220 mm/s, and fixed by means of laser light having been irradiated from the laser light source 105 and passed through the condensing lens 112, whereby a fixed image sample was formed. The fixed image sample was evaluated in terms of fixability based on a rubbing test using an abrasive eraser. Here, the sheet of recording paper P used in this example had a thickness of 0.1 mm. In a case of using a cardboard as the sheet of recording paper P, the thickness of the recording paper P will be about 0.25 mm. The toner image in this example had a thickness of 0.015 mm. In a case of color printing, the maximum number of layers of the toner image will be three, and the toner image will have a thickness of about 0.04 mm.

Next, the evaluation method of the rubbing test in this example will be described below. In the evaluation method, the surface of the fixed image sample was rubbed back and forth in three complete motions using an abrasive eraser with a constant load (1 kgf) applied on the abrasive eraser, and the concentration ratio (residual rate) of the fixed image sample before and after being subject to rubbing was worked out.

The result obtained in the rubbing test will be described below.

Figure 3:
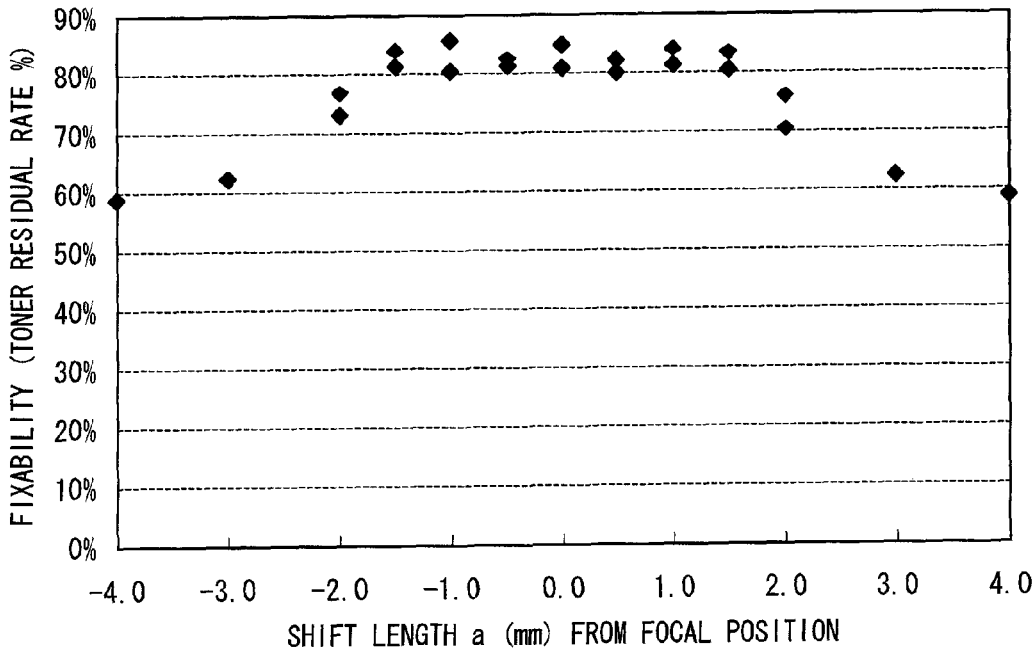
FIG. 3 is a graph showing the relation between the fixability and the shift length from a focal position in a case where the focal position is 48 mm.
Figure 4:
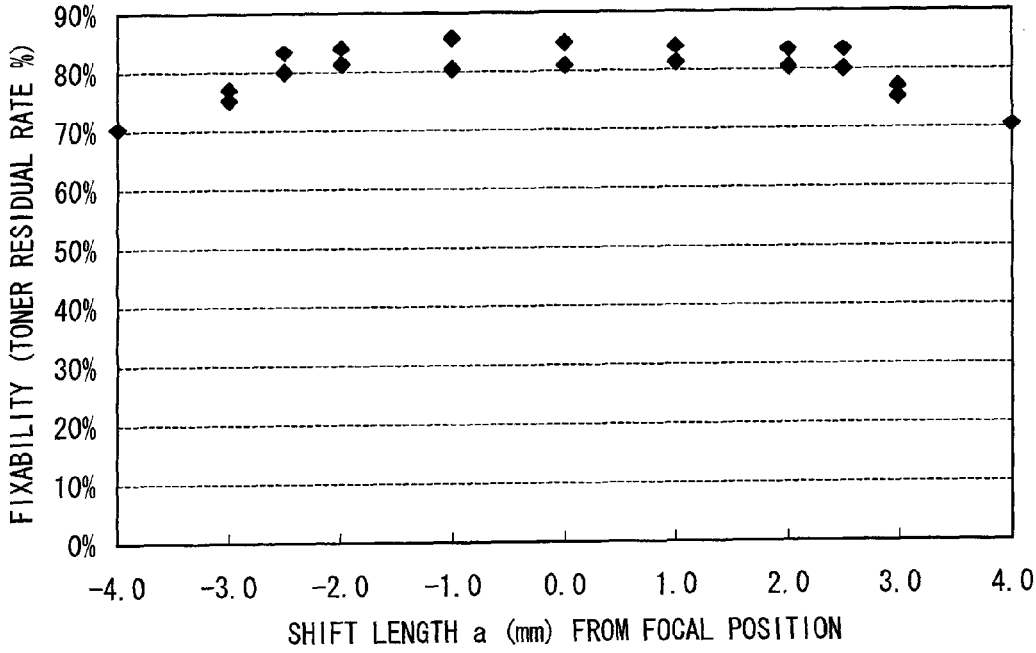
FIG. 4 is a graph showing the relation between the fixability and the shift length from a focal position in a case where the focal position is 72 mm.
Figure 5:
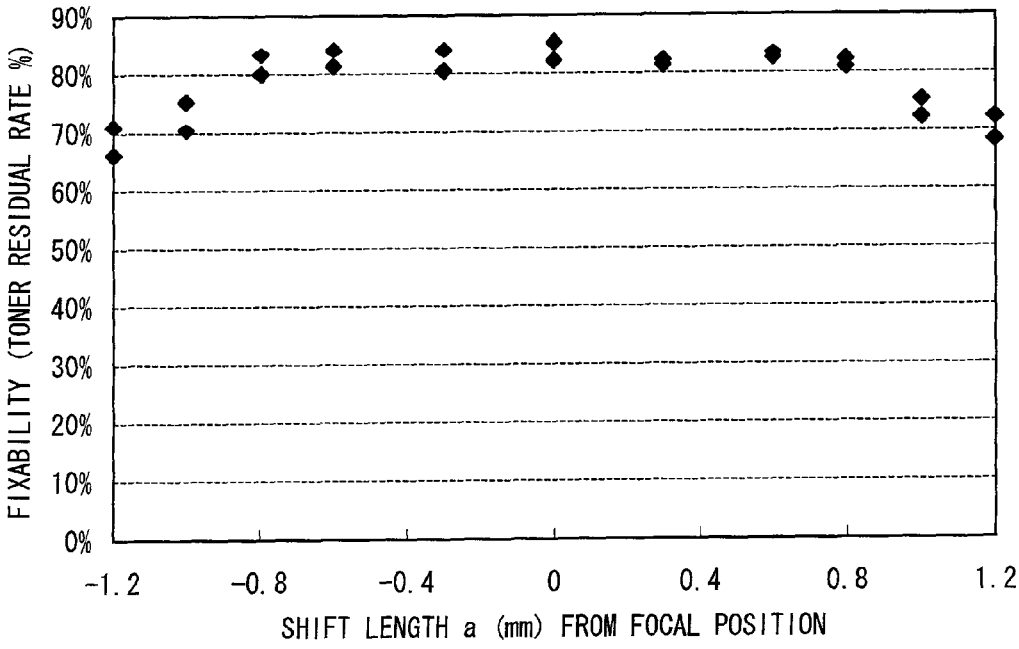
FIG. 5 is a graph showing the relation between the fixability and the shift length from a focal position in a case where the focal position is 24 mm.

In each of FIGS. 3 to 5, the horizontal axis is the shift length (distance) a from the focal position and the vertical axis is the residual ratio (fixability, fixation strength) in the rubbing test carried out under the condition of having the shift length a. FIGS. 3 to 5 each is a graph showing the relation between the shift length a and the flexibility. Here, the shift length a is a positive value in a case of shifting away from the condensing lens 112 in the optical axial direction of the laser light, and the shift length a is a negative value in a case of shifting toward the condensing lens 112 in the optical axial direction of the laser light. The shift length from the focal position is a distance measured along the optical axial direction of the laser light.

FIG. 3 shows the relation between the shift length and the fixability in a case where the recording paper carrying belt 103 surface position was shifted in the optical axial direction using a condensing lens 112 which condenses light best at a focal distance f of 48 mm, under the condition where the laser light output at the focal position was kept constant at 12.5 W. As shown in FIG. 3, the fixability remained almost at the same level while the shift length a from the focal position was within a range of ±1.5 mm. Based on this, by setting the surface of the recording paper carrying belt 103 to pass through a position within this range, it is possible to carry out fixation under the best fixability condition. This range, namely, a range within which substantially the same level of fixability as that at the focal position is obtained, for example, a range within which the obtained fixability is at a level different from that of the fixability at the focal position by only a few percent, will be referred to as a permissible range.

This result teaches the following matter.

In a fixing method using a laser, the energy (J/mm$^2$) received by unfixed toner being carried per unit area is determined by multiplying the light output (W/mm$^2$) per unit area that is applied within the light irradiation area (spot diameter), by the time (s). Therefore, in a case where the same quantity of energy [(light output per unit area)×(light irradiation time)] is applied for fixation, it is preferable to condense light by means of a lens to thereby increase the light output (watt density) per unit area, and shorten the light irradiation time [(high watt density)×(short-time irradiation)]. In this way, it becomes possible to efficiently heat only the toner image, while minimizing heat dissipation to the sheet of recording paper and the atmosphere. The maximum watt density is observed at a focal distance f (focal position B) from the condensing lens 112, specifically at a position 48 mm away (a=0) in the case of the example whose result is shown in FIG. 3. Thus, it follows that fixation can be most efficiently carried out at this position, since the spot width (light irradiation width along the paper carrying direction) is minimized at this position. It is understood, however, that the toner image can be fixed even at a position shifting from the focal position, since the toner image is given energy of a quantity worked out by multiplying the light output per unit area by the light irradiation time, as described above.

Therefore, in the case where the condensing lens that condenses light best at a focal distance f of 48 mm is used, substantially the same level of fixability (fixation strength) as that at the focal position is obtained while the shift length a from the focal position is within the permissible range of ±1.5 mm from the focal position.

Next, the condensing 112 was replaced, and a condensing lens that condenses light best at a focal distance f of 72 mm was used as the condensing lens 112 to carry out measurement in terms of the relation between the shift length a from the focal position and the fixability under the same experimental condition as in the above-described experiment using the condensing lens with a focal distance f of 48 mm. The result of this experiment is shown in FIG. 4.

FIG. 4 indicates that the fixability remained almost at the same level while the shift length a from the focal position was within a permissible range of ±2.5 mm. Based on this, in the case of using the condensing lens that condenses light best at a focal distance f of 72 mm, it is possible to carry out fixation with substantially the same level of fixability as that at the focal position by setting the surface of the recording paper carrying belt 103 to pass through a position within the permissible range of ±2.5 mm from the focal position.

Likewise, using a condensing lens with a focal distance f of 24 mm as the condensing lens 112, measurement was carried out in terms of the relation between the shift length a from the focal position and the fixability under the same experimental condition as in the above-described experiment. The result is shown in FIG. 5. As shown in FIG. 5, the fixability remained almost at the same level while the shift length a from the focal position was within a range of ±0.8 mm. Thus, in the case of using the condensing lens that condenses light best at a focal distance f of 24 mm, it is possible to carry out fixation with substantially the same level of fixability as that at the focal position by setting the surface of the recording paper carrying belt 103 to pass through a position within the permissible range of ±0.8 mm from the focal position.

In each of the above-described experiments, the permissible range was set as a range that within which substantially the same level of fixability as that at the focal position, specifically, a range within which fixability at a level that is different from that of the flexibility at the focal position by only a few percent is obtained. Consequently, at a position L that satisfies a relation: $f-a \leqq L \leqq f+a$, substantially the same level of fixability is obtained as that at the focal position, wherein a is a distance (mm) from the focal position of the condensing lens 112 to a position within the above-described permissible range along the optical axial direction.

Further, by setting the surface of the recording paper carrying belt 103 to pass through a position away from the center of the condensing lens 112 by a distance L (mm) in the optical axial direction, L satisfying the relation: $f<L \leqq f+a$, it is possible to secure substantially the same level of fixability as that at the focal position, even if the thickness of the sheet of recording paper P changes depending on the type of the sheet of recording paper to be carried or the sheet of recording paper P is lifted while being carried. This will be described in detail as follows.

When the surface of the recording paper carrying belt 103 passes through the position L ($f<L \leqq f+a$), the sheet of recording paper P placed on the surface of the recording paper carrying belt 103 and the toner image on the sheet of recording paper P come slightly closer to the condensing lens 112 than the surface of the recording paper carrying belt 103 but still pass through a position (the focal position or a position giving substantially the same level of fixability as that at the focal position) that gives fixability within a permissible range. Consequently, it is possible to efficiently and reliably fix the unfixed toner image on the sheet of recording paper P even in a case where the sheet of recording paper P misses the focal position, for example, in a case where the thickness of the sheet of recording paper P changes depending on the type of the sheet of recording paper or in a case where the sheet of recording paper P is lifted while being carried.

The sheet of recording paper P that can be used in the image forming apparatus 1 has a much smaller thickness than the length a. Due to this, even if the surface of the recording paper carrying belt 103 is set to pass through a position near f, there is little possibility that the sheet of recording paper P on the recording paper carrying belt 103 will come closer to the condensing lens 112 than the position f−a. Therefore, fixability within the permissible range can always be obtained.

As described above, it is preferable that the surface of the recording paper carrying belt 103 pass a position away from the center of the condensing lens 112 in the optical axial direction by the distance L (mm), wherein L satisfies the relation: $f<L \leqq f+a$.

Figure 6:
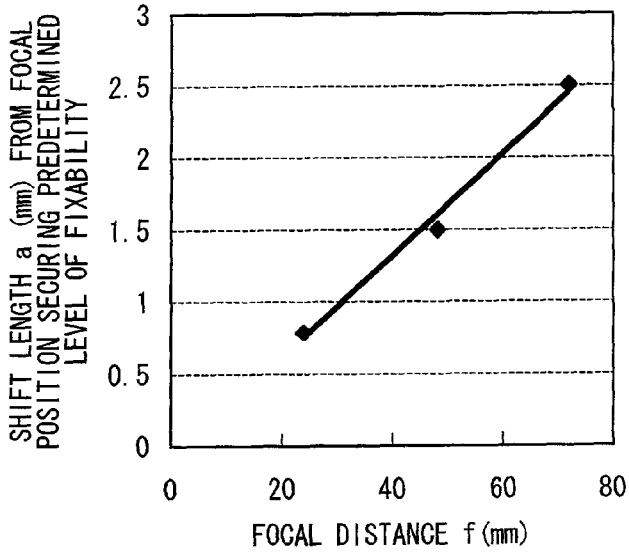
FIG. 6 is a graph showing the relation between the focal distance and the shift length from a focal position which shift length secures a predetermined level of fixability.

Further, based on the above-described experimental results, FIG. 6 plots the relation between the distance (shift length) a from the focal point, which distance keeps substantially the same level of fixability as that at the focal position (the shift length a that secures fixability of 80% or more in FIGS. 3 to 5) when the focal distance f is changed, and the focal distance f.

As shown in FIG. 6, the distance a that keeps substantially the same level of fixability as that at the focal position satisfies a condition expressed by the formula: $a=0.0354 \times f-0.1$ in the relation with the focal distance f. Here, as shown in FIG. 1, when B is the position (focal position) at which light emitted from the laser light source 105 is best condensed by the condensing lens 112, f is the distance (focal distance) (mm) between the center of the condensing lens 112 and the focal position B, and a is the distance (mm) between the focal position B and the position C away from the focal position B in the optical axial direction.

Thus, if the distance a satisfies the condition expressed by the formula: $a=0.0354 \times f-0.1$, fixability within a range from the focal position of the condensing lens 112 to a position away from the focal position of the condensing lens 112 by the distance a along the optical axial direction is substantially at the same level as the fixability at the focal position. Thus, it is possible to reliably fix the toner image.

Further, in production of the fixing device 40, it will suffice to set the surface of the recording paper carrying belt 103 to pass through the position satisfying the relation: $f<L \leqq f+a$, and there is no need of accurately matching the surface position with the focal distance as in conventional cases.

It has been determined that substantially the same level of fixability as that at the focal position is obtained within the permissible range. Here, in a case where the thickness of the sheet of recording paper changes depending on the type of the sheet of recording paper to be carried or in a case where the sheet of recording paper is lifted while being carried, the surface of the sheet of recording paper, or, to be exact, the toner image present on the sheet of recording paper, is present closer to the condensing lens 112 than the surface of the recording paper carrying belt 103. By setting the tension roller 113 at the laser light irradiation position as illustrated in FIG. 1, it is possible to suppress a shift of the toner image present on the sheet of recording paper in a direction away from the focal position.

Accordingly, it is possible to secure the widest margin in terms of fixability by setting the surface of the recording paper carrying belt 103 to pass through the position L=f+a in consideration of the shift in the position at which the toner image is irradiated with the laser light, the shift being caused by the thickness change of the sheet of recording paper P to be carried depending on the type thereof, the lift of the sheet of recording paper P, or the like. Here, L is a distance from the center of the condensing lens 112 along the optical axial direction of the laser light in a direction from the condensing lens 112 toward the recording paper carrying belt 103.

That is, even when the sheet of recording paper P has a significantly large thickness or is lifted to a large extent, the sheet of recording paper on the surface of the recording paper carrying belt 103 and the toner image on the sheet of recording paper pass through the focal position or a position within the permissible range, although the sheet of recording paper on the surface of the recording paper carrying belt 103 and the toner image on the sheet of recording paper come slightly closer to the condensing lens 112 than the surface of the recording paper carrying belt 103. Consequently, it is possible to efficiently and reliably fix the unfixed toner image on the sheet of recording paper.

Configuration of the Present Invention

A laser fixing device of the present invention includes: a carrying section having a carrying member for carrying a recording material placed on a surface of the carrying member; a laser irradiation section; and at least one condensing lens, one of which is a final condensing lens being the last condensing lens that the laser light passes through among the at least one condensing lens; the laser fixing device fixing unfixed toner on the recording material to the recording material by melting the unfixed toner with laser light having been irradiated from the laser irradiation section and passed through the condensing lens, the recording material being carried by the carrying section in a direction perpendicular to an optical axial direction of the laser light, wherein the surface of the carrying member passes through a position satisfying a relation: $f<L\leqq f+a$, where L is a distance (mm) from the center of the final condensing lens to the position along the optical axial direction, f is a focal distance (mm) of the final condensing lens and a is a range (mm) along the optical axial direction from the focal position of the final condensing lens to a position, within which range fixability of toner is within a set permissible range.

In this configuration, a is a range (mm) along the optical axial direction from the focal position of the final condensing lens to a position, within which range fixability of toner is within a set permissible range. Consequently, fixability (fixation strength) within the permissible range is obtained at a position L that satisfies a relation: $f-a\leqq L\leqq f+a$. Therefore, by setting the permissible range as a range within which substantially the same level of fixability as that at the focal position is obtained, for example, a range within which the obtained fixability is at a level different from that of the fixability at the focal position by only a few percent, it becomes possible to obtain substantially the same level of fixability as that at the focal position, at a position L that satisfies the relation: $f-a\leqq L\leqq f+a$.

In this configuration, the surface of the carrying member passes through a position away from the center of the final condensing lens by a distance L (mm) in the optical axial direction, L satisfying the relation: $f<L\leqq f+a$. Because of this, the surface of the carrying member passes through the position L ($f<L\leqq f+a$), even if the thickness of the recording material changes depending on the type of the recording material to be carried or a so-called lift occurs in which the recording material is lifted from the carrying member while being carried. Consequently, the recording material placed on the surface of the carrying member and the toner image on the recording material pass through a position (the focal position or a position giving substantially the same level of fixability as that at the focal position) that gives fixability within the permissible range, although the recording material placed on the surface of the carrying member and the toner image on the recording material come slightly closer to the final condensing lens than the surface of the carrying member. Therefore, it is possible to efficiently and reliably fix the unfixed toner image on the recording material, even in a case where the recording material misses the focal position, for example, in a case where the thickness of the recording material changes depending on the type of the recording material or the recording material is lifted while being carried.

The sheet of recording material that can be used in the image forming apparatus has a much smaller thickness than the length a. Due to this, even if the surface of the carrying member is set to pass through a position near f, there is little possibility that the recording material on the carrying member will come closer to the final condensing lens than the position f−a. Therefore, fixability within the permissible range can always be obtained.

Further, in production of the laser fixing device, it will suffice to set the surface of the recording material to pass through the position satisfying the relation: $f<L\leqq f+a$, and there is no need of accurately matching the surface position with the focal distance as in conventional cases.

Here, it is preferable that the distance a satisfies the formula: $a=0.0354\times f-0.1$. If the distance a satisfies this formula, fixability within a range from the focal position of the final condensing lens to a position away from the focal position of the final condensing lens by the distance a in the optical axial direction is substantially at the same level as the fixability at the focal position. Thus, it is possible to reliably fix the unfixed toner image to the recording material.

In the laser fixing device of the present invention, the surface of the carrying member may pass through a position at a distance L (mm) from the center of the final condensing lens along the optical axial direction, the distance L satisfying a relation: L=f+a.

As in this configuration, when the surface of the carrying member is set to pass through a position at a distance L (mm) from the center of the final condensing lens along the optical axial direction, the distance L satisfying the relation: L=f+a, it is possible to secure the widest margin in terms of fixability at the position where the carrying member is set. That is, even when the recording material has a significantly large thickness or is lifted to a large extent, the recording material on the surface of the carrying member and the toner image on the recording material pass through the focal position or a position giving fixability within a predetermined permissible range, although the recording material on the surface of the carrying member and the toner image on the recording material come slightly closer to the final condensing lens than the surface of the carrying member. Consequently, it is possible to efficiently and reliably fix the unfixed toner image on the recording material.

Further, in addition to the above-described configuration, the carrying member may be an endless belt in the laser fixing device of the present invention, and the laser fixing device may have an abutting member for giving a tension to the endless belt, the abutting member provided behind the surface of the endless belt at an irradiation position being a position at which the endless belt is irradiated with the laser light.

The laser light irradiation position on the surface of the endless belt has a risk of departing from the predetermined position in the optical axial direction due to vibrations caused by the driving of the endless belt. Here, by employing the above-described configuration, the laser light irradiation position on the surface of the endless belt can be kept at an accurate position due to the tension applied by the abutting member from the rear surface of the endless belt to the endless belt. As a result, the recording material carried on the surface of the endless belt that is kept at the accurate position always pass through a constant laser light irradiation position. Consequently, the unfixed toner image is always efficiently and reliably fixed to the recording material.

In the laser fixing device according to the present invention, the endless belt may be electrically conductive on the surface thereof, and the laser fixing device may include a bias application section for applying an electric bias to the endless belt, in addition to the above-described configuration.

According to this configuration, an electric bias is applied to the electrically conductive endless belt by the bias application section, whereby the recording material is electrostatically adsorbed to the endless belt. As a result, the surface of the endless belt and the rear surface of the recording material are brought into a close contact with each other, thereby preventing a lift of the recording material. Consequently, it is possible to more reliably fix the unfixed toner image to the recording material.

In order to attain the object, an image forming apparatus according to the present invention includes any one of the laser fixing devices of the present invention.

According to the above-described configuration, it is possible to efficiently and reliably fix the unfixed toner image on the recording material to thereby form high-quality image, even in a case where the thickness of the recording material changes depending on the type of the recording material or the recording material is lifted while being carried.

The present invention is not limited to the above-described embodiments but allows various modifications. That is, any embodiment obtained by combining technical means appropriately modified within the scope of the claimed invention will also be included in the technical scope of the present invention.

INDUSTRIAL APPLICABILITY

The present invention is applicable to a laser fixing device included in an image forming apparatus of an electrophotographic printing type such as a printer, a copying machine, a facsimile, an MFP (Multi Function Printer), and to the image forming apparatus.

REFERENCE SIGNS LIST

1: IMAGE FORMING APPARATUS
40: FIXING DEVICE (LASER FIXING DEVICE)
50, 50Y, 50M, 50C, 50B: VISIBLE IMAGE FORMING UNIT
51: PHOTORECEPTOR
52: CHARGER
54: DEVELOPER
55: TRANSFER ROLLER
56: CLEANER UNIT
101: TENSION ROLLER
102: TENSION ROLLER
103: RECORDING PAPER CARRYING BELT (CARRYING MEMBER, ENDLESS BELT)
105: LASER LIGHT SOURCE (LASER IRRADIATION SECTION)
107: RECORDING PAPER CARRYING DEVICE (CARRYING SECTION)
110: BIAS APPLICATION MEANS (BIAS APPLICATION SECTION)
111: COLLIMATING LENS
112: CONDENSING LENS (FINAL CONDENSING LENS)
113: TENSION ROLLER (ABUTTING MEMBER)
P: SHEET OF RECORDING PAPER (RECORDING MATERIAL)
T: TONER

The invention claimed is:

1. A laser fixing device comprising:

a carrying section having a carrying member for carrying a recording material placed on a surface of the carrying member;

a laser irradiation section; and at least one condensing lens, one of which is a final condensing lens being a last condensing lens that the laser light passes through among the at least one condensing lens;

the laser fixing device fixing unfixed toner on the recording material to the recording material by melting the unfixed toner with laser light having been irradiated from the laser irradiation section and passed through the condensing lens, the recording material being carried by the carrying section in a direction perpendicular to an optical axial direction of the laser light, wherein the surface of the carrying member passes through a position satisfying a relation:

$f<L\leqq f+a$, where L is a distance (mm) from a center of the final condensing lens to the position along the optical axial direction, f is a focal distance (mm) of the final condensing lens and a is a range (mm) along the optical axial direction from the focal position of the final condensing lens to a position, within which range fixability of toner is within a set permissible range.

2. The laser fixing device of claim 1, wherein said a is found by a formula: $a=0.0354\times f-0.1$.

3. The laser fixing device of claim 1, wherein the surface of the carrying member passes through a position satisfying a relation:

$L=f+a$.

4. The laser fixing device of claim 1, wherein the carrying member is an endless belt, and the carrying section has an abutting member for giving a tension to the endless belt, the abutting member provided behind the surface of the endless belt at an irradiation position being a position at which the endless belt is irradiated with the laser light.

5. The laser fixing device of claim 4, wherein the endless belt is electrically conductive on the surface thereof, and the carrying section includes a bias application section for applying an electric bias to the endless belt.

6. An image forming apparatus including a laser fixing device of claim 1.

* * * * *